US008714537B2

(12) United States Patent
Smith et al.

(10) Patent No.: US 8,714,537 B2
(45) Date of Patent: May 6, 2014

(54) LIFTING DEVICE CLAMP HAVING A CURVILINEAR SURFACE

(75) Inventors: Jeffrey A. Smith, Springfield, MA (US); William J. Derwin, West Hartford, CT (US); Jeffrey M. Dickinson, Manchester, CT (US); John E. Cegelka, East Hartland, CT (US); Craig A. Buckley, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 918 days.

(21) Appl. No.: 12/445,744

(22) PCT Filed: Nov. 21, 2006

(86) PCT No.: PCT/US2006/061131

§ 371 (c)(1), (2), (4) Date: Apr. 16, 2009

(87) PCT Pub. No.: WO2008/063191

PCT Pub. Date: May 29, 2008

(65) Prior Publication Data

US 2010/0207311 A1 Aug. 19, 2010

(51) Int. Cl.
*B25B 5/10* (2006.01)

(52) U.S. Cl.
USPC ..... 269/240; 269/45; 269/101; 24/68 R

(58) Field of Classification Search
USPC ..... 269/240, 271, 43, 143, 249, 6, 3; 81/424.5, 487
See application file for complete search history.

(56) References Cited

U.S. PATENT DOCUMENTS

| | | | | |
|---|---|---|---|---|
| 3,425,098 | A * | 2/1969 | Bredvik | 24/68 R |
| 4,183,571 | A * | 1/1980 | Renfroe | 294/101 |
| 4,491,358 | A * | 1/1985 | Choung | 294/101 |
| 5,141,276 | A | 8/1992 | McClure | |
| 5,630,576 | A * | 5/1997 | Williams | 269/45 |

FOREIGN PATENT DOCUMENTS

| | | |
|---|---|---|
| GB | 2212780 A1 | 2/1989 |
| SU | 914475 | 3/1992 |

OTHER PUBLICATIONS

International Search Report and Written Opinion of the International Searching Authority for International application No. PCT/US2006/061131 mailed Sep. 13, 2007.
International Preliminary Report on Patentability for International application No. PCT/US2006/061131 mailed Jan. 13, 2008.

* cited by examiner

*Primary Examiner* — Lee D Wilson
*Assistant Examiner* — Melanie Alexander
(74) *Attorney, Agent, or Firm* — Carlson, Gaskey & Olds

(57) ABSTRACT

A clamp device (30) includes a plurality of arms (32, 34). One of the arms supports a securing member (36). The other arm includes a curvilinear surface (40) that directly engages a curved wall of an article at a location in line with a centerline of the securing member. The curvilinear surface (40) allows for the clamp device to reliably engage an article having a curved wall for a lifting operation. One example use of a disclosed example device is for lifting tubes associated with a hydraulic elevator system.

16 Claims, 3 Drawing Sheets

LIFTING DEVICE CLAMP HAVING A CURVILINEAR SURFACE

TECHNICAL FIELD

This invention generally relates to devices for clamping and lifting articles. More particularly, this invention relates to such a device for lifting an article including a curved wall.

DESCRIPTION OF THE RELATED ART

There are various instances where an article must be lifted in a vertical direction. Various techniques are used for such procedures. Lifting plate-like articles or items having planar walls has been accomplished using a clamping device. Such a clamping device typically includes a cup point screw for at least partially penetrating one side of the plate or wall. The clamp includes a flat wall facing opposite the cup point screw for supporting the plate or flat wall while the cup point screw is tightened into position.

While such a device is useful for lifting plate-like articles or grabbing a generally planar wall on an article, the device is not useful for round pipes or other curved wall articles. When the flat surface of the clamp is placed against a curved wall, a gap exists between the surface of the clamp and the wall in the vicinity of the cup point screw. This gap prevents desired interaction between the cut point screw and the curved wall. Depending on the material of the wall, it may become deformed as the cup point screw is tightened or, at least, inadequate engagement between the cup point screw and the wall occurs. Accordingly, such devices are not used for lifting round pipes or other curved wall articles.

One technique that has been used in the elevator industry for lifting the tubes associated with a hydraulic elevator system includes drilling or torching a hole in the pipe. An anchor shackle is attached to the hole to provide a lifting point. While such a procedure can provide a reliable arrangement for lifting the pipe, the process is time-consuming, inconvenient and results in undesired hot metal shards, sparks, fumes, smoke or a combination of these.

SUMMARY

An exemplary clamp device includes a plurality of arms with a spacing between the arms. A securing member is supported by a first one of the arms and is moveable toward a second one of the arms to engage a curvilinear wall that is at least partially received in the spacing between the arms. The second one of the arms has a curvilinear surface facing toward the securing member for being received against and supporting a portion of the curvilinear wall at a location that is in line with a center of the securing member.

An exemplary assembly comprises a tube having a curvilinear wall. A first clamp arm is positioned near an exterior face of the curvilinear wall. A securing member is supported by the first clamp arm and is moveable relative to the first clamp arm. A second clamp arm is spaced from the first clamp arm. The second clamp arm has a curvilinear surface facing toward the securing member for abutting against and supporting a portion of the curvilinear wall that is received between the first and second clamp arms. The curvilinear surface abuts against the curvilinear wall at a location that is in line with a center of the securing member.

The various features and advantages of this invention will become apparent to those skilled in the art from the following detailed description. The drawings that accompany the detailed description can be briefly described as follows.

DETAILED DESCRIPTION

Figure 1:
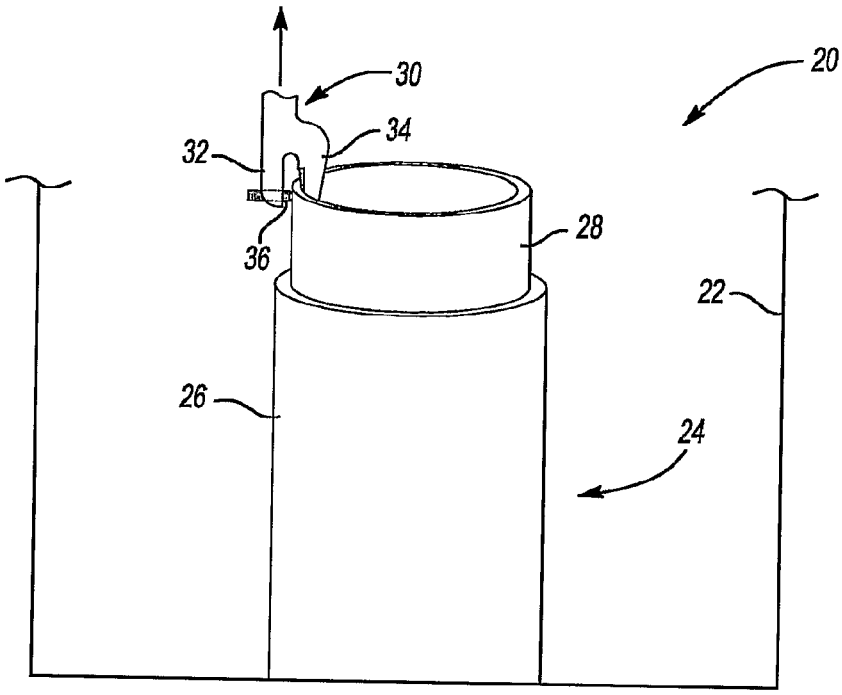
FIG. 1 schematically illustrates one example use of a clamp device designed according to one example embodiment.

A disclosed example clamp device is useful for lifting articles that have curved walls including round pipes. FIG. 1 schematically illustrates one example use of such a device. FIG. 1 schematically shows an assembly 20 that is useful as a portion of an elevator system. In the illustration, a portion of an elevator pit 22 includes a hydraulic arrangement 24 for moving an elevator car in a known manner. In this example, two pipes 26 and 28 are oriented vertically within the pit 22 for known reasons.

The example assembly 20 includes a clamp device 30 that is useful for lifting the pipes 28 and 26 into or out of a desired position within the pit 22. The clamp device 30 includes a first arm 32 spaced from a second arm 34. A portion of the pipe 28 in the illustration is received at least partially within the spacing between the arms 32 and 34. The arm 32 supports a securing member 36 that engages a surface on the pipe 28 for clamping the pipe 28 in a manner that secures the pipe for lifting it in a vertical direction.

While pipes associated with an elevator system are shown as an example article that can be lifted by the example clamp device 30, this invention is not necessarily limited to elevator systems. Lifting pipes associated with an elevator system constitutes one example use of the disclosed example clamp device 30. Given this description, those skilled in the art will realize what other situations will prove the example clamp device 30 to be useful.

Figure 2:
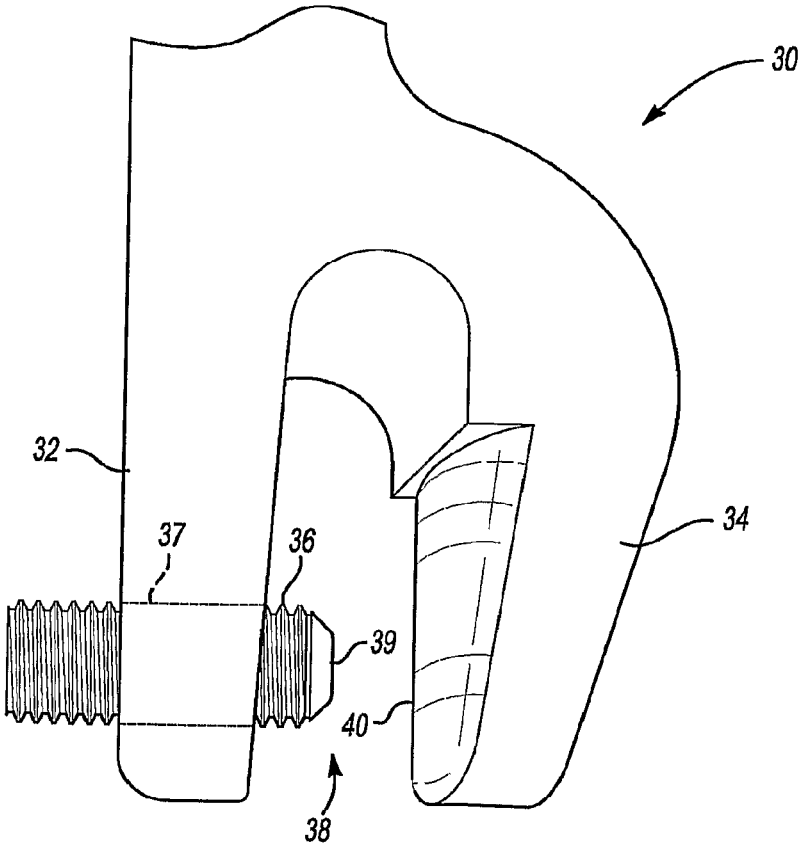
FIG. 2 is a perspective illustration of selected portions of an example clamp device.

FIG. 2 shows another example clamp device 30 having a first arm 32 and a second arm 34. In the example of FIG. 2, a securing member 36 comprises a threaded member that is received at least partially within a correspondingly threaded hole 37 in the first arm 32. In one example, the securing member 36 is a screw. Rotating the securing member 36 controls the amount that the securing member 36 protrudes into the spacing 38 between the first arm 32 and the second arm 34. In this example, an end 39 of the securing member 36 is chamfered to facilitate the securing member engaging an article such as a round tube that is intended to be lifted by the clamp device 30. In some instances, the chamfered edge 39 facilitates at least partially penetrating into the material of the article (e.g., a tube) that will be lifted using the clamp device 30.

At least partially penetrating into the material of the curved wall provides adequate gripping strength. Such a device operates under the principle that once the securing member is at least partially penetrated into the material of the article being lifted, the material between the securing member and the end of the gripped portion of the article would have to be sheered off before the article would be able to fall out of the clamping device.

The second arm 34 includes a curvilinear surface 40 that abuts and supports the curved wall of the article at least partially received within the spacing 38. The curvilinear surface 40 provides for direct abutting engagement with a surface on the curved wall in a location directly aligned with a center of the securing member 36 to support the wall at that location to facilitate the desired coupling between the clamp device 30 and, the article of interest.

Figure 3:
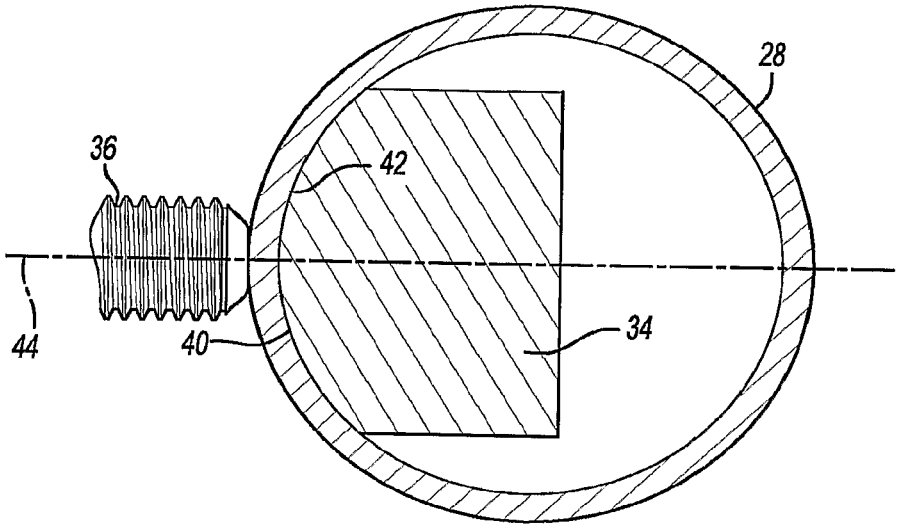
FIG. 3 is a partial, cross-sectional illustration showing one example use of the embodiment of FIG. 2.

FIG. 3 shows one example arrangement where the second arm 34 includes the curvilinear surface 40 that has a contour sized to correspond to an inner wall 42 on a pipe 28. In this example, the radius of curvature of the curvilinear surface 40 essentially matches that of the inner wall 42 of the pipe 28. As can be appreciated from FIG. 3, the curvilinear surface 40 provides for direct, abutting engagement between the second arm 34 and the inner surface 42 on the pipe 28 at a location in line with a centerline 44 of the securing member 36. Abutting and supporting the material of the pipe 28 at this location is required, in some examples, to achieve appropriate engagement between the securing member 36 and the pipe 28.

Figure 4:
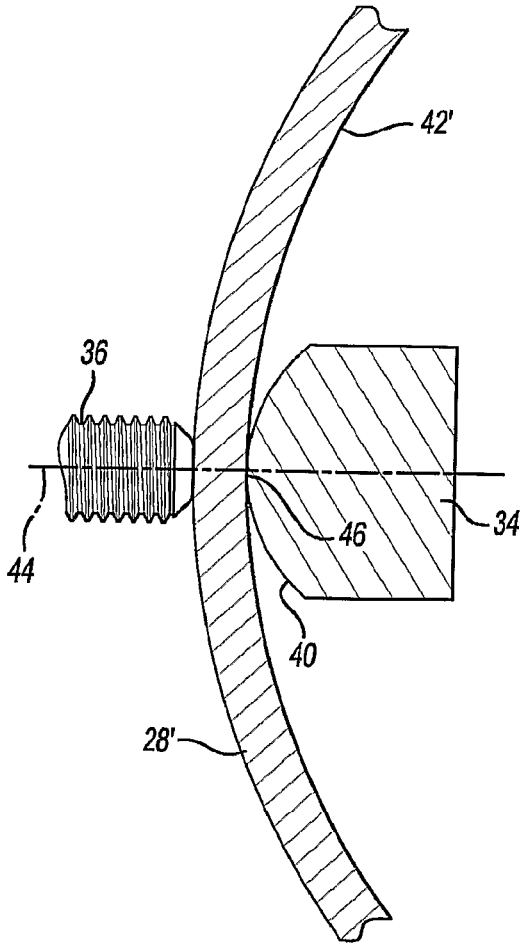
FIG. 4 is a partial, cross-sectional illustration showing one example use of the embodiment of FIG. 2.

FIG. 4 schematically shows another arrangement where the same clamp device 30 is used with a much larger sized pipe 28' (larger relative to the size shown in FIG. 3). In FIG. 4, the curvilinear surface 40 engages the inner surface 42' at least at the location 46 that is in line with the centerline 44 of the securing member 36. In this example, the radius of the inner surface 42' of the pipe 28' is approximately five times that of the radius of curvature of the curvilinear surface 40. Given this description, those skilled in the art will be able to determine what ratio between the radii of the curved wall of the article to be lifted and the curvilinear surface 40 on the second arm 34 will facilitate appropriate gripping of the article for using a particular sized clamping device 30. The clamping device 30 can accommodate a range of pipe sizes.

Figure 5:
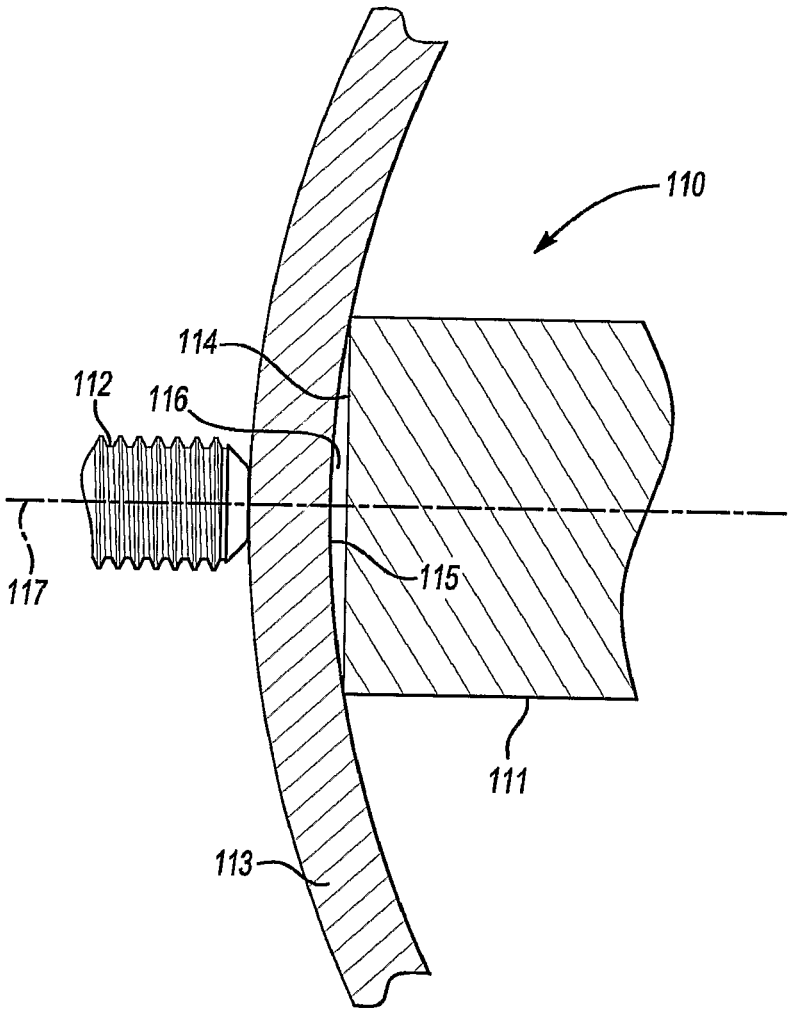
Fig-5 PRIOR ART
FIG. 5 schematically illustrates a prior art arrangement.

Without the curvilinear surface 40, it would not be possible to use the type of clamping device 30 as shown in FIG. 2. Considering FIG. 5 as an example, if the second arm 32 had a planar surface facing the securing member, it would not be possible to reliably or consistently grip an article having a curved wall for a lifting operation. In the example of FIG. 5, an assembly 110 includes a clamping device having an arm 111 and a securing member 112. In this example, an article having a curved wall 113 (e.g., a round pipe) is at least partially received between the securing member 112 and the arm 111. Because the arm 111 has a planar surface 114 facing the securing member 112, the inner wall surface 115 does not contact the surface 114 on the arm 111. Accordingly, a gap 116 exists at the location that is in line with the centerline 117 of the securing member 112. Such a gap 116 prevents desired engagement of the securing member 112 and the curved wall 113. The gap 116 allows for undesired deformation of the curved wall 113 in some examples. In other examples, the gap 116 prevents adequate engagement of the securing member 112 because the securing member 112 is not able to at least partially penetrate into the material of the curved wall 113.

Using a curvilinear surface 40 on a clamping device as shown in the examples of FIGS. 2-4 eliminates the gap 116 and provides a clamping device 30 that is useful for reliably lifting an article having a curved wall, such as a round tube or pipe.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A clamp device, comprising a plurality of arms with a spacing between the arms;

a securing member that is supported by a first one of the arms and is moveable toward a second one of the arms to engage an exterior surface of a curvilinear wall that is at least partially received in the spacing between the arms;

the second one of the arms having a curvilinear surface with a convex profile facing toward the securing member for being received against and supporting a portion of the interior surface of the curvilinear wall at a location that is in line with a center of the securing member, the curvilinear surface remaining in a fixed position relative to the arms.

2. The device of claim 1, wherein the securing member comprises a threaded exterior and the first one of the arms includes a threaded opening that at least partially receives the securing member and wherein rotation of the securing member adjusts a position of the securing member in the spacing.

3. The device of claim 2, wherein the securing member comprises a screw.

4. The device of claim 1, wherein the securing member has a chamfered end facing the curvilinear surface on the second one of the arms.

5. The device of claim 1, wherein the curvilinear surface has a radius of curvature that is approximately equal to a radius of curvature on the curvilinear wall.

6. The device of claim 1, wherein the curvilinear surface has a radius of curvature that is less than a radius of curvature on the curvilinear wall.

7. The device of claim 1, wherein the spacing between the arms remains always fixed.

8. The device of claim 1, wherein the securing member comprises a screw.

9. An assembly, comprising a pipe of a hydraulic elevator system having a curvilinear wall; and a lifting device for lifting the pipe into a desired position in an elevator system, the lifting device including:

first clamp arm near an exterior face of the curvilinear wall;

a securing member supported by the first clamp arm that is moveable relative to the first clamp arm to selectively engage the exterior face of the curvilinear wall;

a second clamp arm spaced from the first clamp arm, the second clamp arm having a curvilinear surface with a convex profile facing toward the securing member for abutting against and supporting a portion of an interior face of the curvilinear wall that is received between the first and second clamp arms, the curvilinear surface abutting against the curvilinear wall at a location that is in line with a center of the securing member.

10. The assembly of claim 9, wherein the securing member comprises a threaded exterior and wherein rotation of the securing member adjusts a position of the securing member relative to the portion of the tube received between the first and second clamp arms.

11. The assembly of claim 10, wherein the securing member comprises a screw.

12. The assembly of claim 9, wherein the securing member has a chamfered end facing the curvilinear surface.

13. The assembly of claim 9, wherein the curvilinear surface has a radius of curvature that is approximately equal to a radius of curvature on the curvilinear wall.

14. The assembly of claim 9, wherein the curvilinear surface has a radius of curvature that is less than a radius of curvature on the curvilinear wall.

15. The assembly of claim 9, wherein the first and second clamp arms remain always fixed relative to each other.

16. The assembly of claim 9, wherein the securing member at least partially penetrates into a material of the curvilinear wall.

* * * * *